United States Patent [19]

Bigelow

[11] 4,092,171

[45] May 30, 1978

[54] ORGANOPHOSPHINE CHELATES OF PLATINUM AND PALLADIUM AS SENSITIZERS

[75] Inventor: John Howard Bigelow, Rochester, N.Y.

[73] Assignee: E. I. Du Pont de Nemours and Company, Wilmington, Del.

[21] Appl. No.: 659,933

[22] Filed: Feb. 20, 1976

[51] Int. Cl.[2] ..... G03C 1/28
[52] U.S. Cl. ..... 96/108; 96/107
[58] Field of Search ..... 96/108, 107

[56] References Cited

U.S. PATENT DOCUMENTS

| | | | |
|---|---|---|---|
| 2,540,086 | 2/1951 | Baldsiefen et al. | 96/108 |
| 3,804,632 | 4/1974 | Bigelow | 96/108 |
| 3,904,415 | 9/1975 | Oftedahl | 96/108 |
| 3,930,867 | 1/1976 | Bigelow | 96/108 |

FOREIGN PATENT DOCUMENTS

| | | | |
|---|---|---|---|
| 1,295,463 | 11/1972 | United Kingdom | 96/107 |
| 195,872 | 7/1967 | U.S.S.R. | 96/107 |

*Primary Examiner*—Won H. Louie, Jr.

[57] ABSTRACT

Photographic colloid-silver halide emulsions have their sensitivity increased by the addition of at least one organo-phosphine chelate of a palladium or platinum metal salt.

9 Claims, No Drawings

ORGANOPHOSPHINE CHELATES OF PLATINUM AND PALLADIUM AS SENSITIZERS

BACKGROUND OF THE INVENTION

It is known to chemically sensitize photographic silver halide emulsions with a variety of chemical compounds, e.g., noble metal compounds, compounds providing labile sulfur or selenium, etc. Chemical sensitization is considered to result from the formation of silver sulfide specks on the silver halide crystals resulting from the presence of labile sulfur or from the formation of silver specks on the silver halide crystals resulting from the presence of a reduction sensitizer. The sensitizing activity of sulfur and selenium on silver halide emulsions has been well documented, and compounds which have been used in conjunction with these elements are the organic phosphites and organic phosphine compounds. However, there is need for a stronger sensitizer.

SUMMARY OF THE INVENTION

This invention provides a light-sensitive silver halide photographic element comprising a support coated with at least one silver halide emulsion containing as a chemical sensitizer a chelate of an organophosphine with a platinum or palladium salt. These chelates are particularly efficacious in fast negative-type emulsions, but may also be used in other emulsions such as those used in the graphic arts, e.g., lithographic materials, those used in radiographic work, e.g., X-ray films, color films, direct positive films and films used for diffusion transfer processes, which may comprise silver chloride, iodide, bromide or any mixture of these silver halides. Still more particularly, photographic silver halide emulsions chemically sensitized with organophosphine chelates of platinum and palladium metal salts have increased speed and improved stability over emulsions made heretofore.

DETAILED DESCRIPTION OF THE INVENTION

The organophosphine platinum and palladium chelates referred to above may be added at any stage of preparation of the silver halide emulsions, e.g., during the precipitation of the silver halides, after the washing step and redispersion stage, during digestion, or as a final addition just prior to coating. They may be conveniently added to the emulsions from any organic solvent, e.g., lower alkyl alcohols, acetone, trichloromethane, etc. A convenient solvent is ethyl alcohol. The following compounds are representative of useful chelates; in these formulae the term Ph = phenyl.

| Compound No. | Formula | Name |
|---|---|---|
| I | 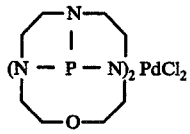 | Dichlorobis(13 phospha-10-oxa-1,4,7-triaza-tricyclo [5.5.1.0$^{4,13}$] tridecane) palladium II |
| II | $[PhP(OCH_2CH_3)_2]_2PtI_2$ | Diiodobis(diethylphenylphosphonite)-platinum(II) |
| III | $[CH_3P(OPh)_2]_2PtCl_2$ | Dichlorobis(diphenyl methylphosphonite)-platinum(II) |
| IV | $(Ph_2POPh)_2PtCl_2$ | Dichlorobis(phenyl diphenylphosphinite)-platinum(II) |
| V | $(Ph_2POCH_3)_2PdCl_2$ | Dichlorobis(methyl diphenylphosphinite)-palladium (II) |
| VI | 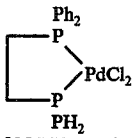 | Dichloro[1,2-bis(diphenylphosphino)ethane]-palladium (II) |
| VII | $[(NCCH_2CH_2)_3P]_2PdCl_2$ | Dichlorobis[tris-(2-cyanoethyl)phosphine]-palladium (II) |
| VIII | 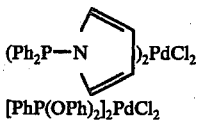 | Dichlorobis(N-pyrryldiphenylphosphine)-palladium (II) |
| IX | $[PhP(OPh)_2]_2PdCl_2$ | Dichlorobis(diphenyl phenylphosphonite)-palladium (II) |
| X | 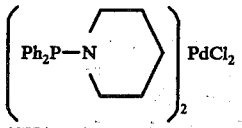 | Dichlorobis(N-piperidinyl-diphenylphosphine)-palladium (II) |
| XI | 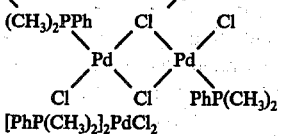 | Chloro(dimethylphenylphosphine)-palladium (II)-$\mu,\mu$-(dichloro)chloro (dimethylphenylphosphine)-palladium (II) |
| XII | $[PhP(CH_3)_2]_2PdCl_2$ | Dichlorobis(dimethylphenylphosphine)-palladium (II) |

-continued

| Compound No. | Formula | Name |
|---|---|---|
| XIII | 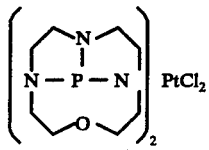 | Dichlorobis(13-phospha-10-oxa-1,4,7-triaza-tricyclo [5.5.1.0$^4$,13] -tridecane)platinum (II) |
| XIV | $[PhP(CH_2Ph)_2]_2PdCl_2$ | Dichlorobis(dibenzyl-phenylphosphine)-palladium (II) |
| XV | 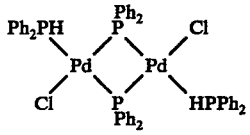 | Chloro(diphenylphosphine) palladium(II)-$\mu,\mu$-bis (diphenylphosphino)chloro (diphenylphosphine) palladium (II) |
| XVI | 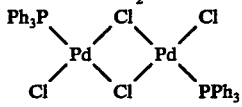 | Chloro(triphenylphos-phine)palladium(II)-$\mu,\mu$-(dichloro)chloro (triphenylphosphine)-palladium (II) |
| XVII | 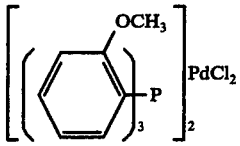 | Dichlorobis(tri-o-methoxy phenylphosphine)-palladium (II) |
| XVIII | $[(CH_3CH_2O)_3P]_2PdCl_2$ | Dichlorobis(triethyl-phosphine)-palladium (II) |
| XIX | $(Ph_3P)_2PdCl_2$ | Dichlorobis(triphenyl-phosphine)-palladium (II) |
| XX | 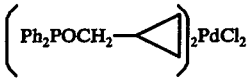 | Dichlorobis(cyclopropyl-methyl diphenylphosphinite) palladium (II) |
| XXI | $(Ph_2PCH_2CH_3)_2PdCl_2$ | Dichlorobis(ethyldiphenyl-phosphine)-palladium (II) |
| XXII | $(Ph_2PCH{=}CH_2)_2PdCl_2$ | Dichlorobis(vinyldiphenyl-phosphine)-palladium (II) |
| XXIII | $(Ph_2POPh)_2PdCl_2$ | Dichlorobis(phenyldiphenyl-phosphinite)-palladium (II) |
| XXIV | 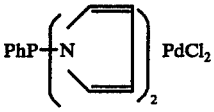 | Dichlorobis(di-N-pyrryl-phenylphosphine)-palladium (II) |
| XXV | 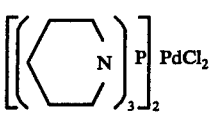 | Dichlorobis(tripiper-idyl-phosphine) Palladium II |

Methods of preparation of the chelates may be found in Organic Phosphorus Compounds, Kosolapoff & Maier, Wiley Interscience, 1972, Vol. I through V. Phosphine complexes are described in Vol. I. Chapter III, A, and aminophosphine complexes in Vol. II, Chapter III, B.

As indicated above, the chelates may be added to a variety of silver halide emulsions and said emulsions may contain optical sensitizing dyes, antifoggants and other chemical sensitizers including conventional sulfur, noble metal, and reduction type sensitizers. The quantity of the various organo-phosphine-platinum and palladium chelates will of course, depend upon the particular type of emulsion and the desired effect and can vary within wide limits. The optimum amount to be added can be determined for each emulsion by simple experiment as is customary in the art of emulsion manufacture. Generally the most suitable concentration will be found to be from $2.5 \times 10^{-6}$ to $3.4 \times 10^{-4}$ moles per 1.5 moles of silver halide in the emulsion.

The following procedures and examples illustrate the invention in a more detailed manner. The silver halide emulsions used in these examples were prepared according to the following procedures:

PROCEDURE A

Chlorobromide Make

To an acidified solution of gelatin containing 1.5 moles of KCl there was rapidly added 1.5 moles of silver nitrate in aqueous solutions. There was then added 0.6 moles of aqueous KBr solution and the mixture allowed to ripen for 10 minutes, after which there was added 0.9 moles of aqueous KBr solution and the mixture allowed to ripen for 10 minutes, all at 160° F. The resulting emulsion was cooled, coagulated, washed and redispersed in the manner disclosed in Moede U.S. Pat. No. 2,772,165.

PROCEDURE B

Iodobromide Make

A gelatino-silver iodobromide emulsion containing 1.6 mole % silver iodide was made by rapidly pouring a solution containing 1.5 moles of $AgNO_3$ plus 3.0 moles of $NH_3$ into a gelatin solution containing 1.5 moles of KBr + KI. The emulsion was ripened 5 minutes at 135° F, and then the $NH_3$ neutralized with acetic acid. The resulting emulsion was cooled, coagulated, washed and redispersed in the manner disclosed in Moede U.S. Pat. No. 2,722,165.

PROCEDURE C

Monodisperse IBr Emulsion Make

An iodobromide (1% $I^-$) emulsion was made by a method in which both soluble silver and iodobromide salts were added to a kettle solution containing 48g of gelatin per 1.5 moles of silver nitrate at a temperature of 115° F, in the presence of insufficient $NH_3$ to convert the silver ion completely, and at a constant pAg ≅ 8 to produce a 0.2 micron average grain size. The emulsion was freed from the soluble salts by a coagulation wash method and redispersed as disclosed Moede U.S. Pat. No. 2,722,165.

PROCEDURE D

Unsensitized Negative Type Emulsion Remelt

To a silver halide emulsion containing the equivalent of 1.5 moles of silver nitrate there was added bulking gelatin and the temperature was raised to 130° F. The pH was adjusted to 8 with borax and the mixture was digested for 40 minutes at 130° F. The pH was adjusted to 5.5, coating aids including gelatin hardeners were added, and the emulsions were coated on a photographic quality film base and dried in a conventional manner.

PROCEDURE E

Sensitized Negative Type Emulsion Remelt

To a silver halide emulsion containing the equivalent of 1.5 moles of silver nitrate there was added bulking gelatin and the temperature was raised to 110° F. The pH was adjusted to 6.5. The emulsion was heated to 125° F., and there was added $3.3 \times 10^{-6}$ mole of gold ($Au^{+3}$) in the form of a conventional gold sensitizing compound and $1.74 \times 10^{-5}$ mole of $S_2O_3^{-2}$ as sodium thiosulfate. The emulsion was then digested for 60 minutes at 125° F. The pH was then adjusted to 5.5, coating aids including a gelatin hardener were added, and the emulsions were coated on a photographic quality film support and dried in a conventional manner.

EXAMPLE 1

A silver chlorobromide emulsion was made as described under Procedure A and remelted according to Procedure E above. The emulsion was divided into two portions, one of which was used as a control to which was added a conventional sulfur sensitizer in addition to the sodium thiosulfate of the remelt procedure. To the other portion there was added $3.4 \times 10^{-4}$ mole per 1.5 moles of silver halide of compound I above in place of the sulfur sensitizer. The emulsions were coated on a photographic film base and dried in the conventional manner. Sensitometric strips of the samples were exposed in a sensitometer through a $\sqrt{2}$ step wedge by means of a quartz-iodine lamp under conditions providing an exposure of 4470 meter-candle-seconds. The strips were machine processed for 22 seconds at 100° F in an automatic processing machine in a conventional hydroquinone developer to give the results shown in the following table.

TABLE I

| Sample No. | Testing Conditions | Dmin. | Dmax. | Gradient (Density=.3 to 1.9) |
|---|---|---|---|---|
| 1 (Control) | Fresh | .08 | 2.20 | 1.29 |
| | OT* | .07 | 2.18 | 1.36 |
| 2 Compound I | Fresh | .03 | 2.58 | 1.93 |
| | OT* | .03 | 2.54 | 1.50 |

*Oven aging conditions of 120° F. at 65% R.H. for 7 days.

The results show that the organophosphinepalladium chelate gave higher maximum density, greater contrast and lower fog than the control sensitized with only gold and sulfur sensitizers.

EXAMPLE 2

Example 1 was repeated through the remelt procedure. One emulsion was sensitized with the gold salt of the remelt procedure and was used as a control. To the other emulsion there was added in place of the gold salt, $2.5 \times 10^{-4}$ mole per 1.5 moles of silver halide of Compound I above. Testing conditions were the same as in Example I. The results are shown in the following table.

TABLE II

| Sample No. | Testing Conditions | Dmin. | Dmax. | Gradient (Density=0.3 to 1.9) |
|---|---|---|---|---|
| 1 (Control) | Fresh | .03 | .52 | — |
| | Age | .03 | .46 | — |
| 2 Compound I | Fresh | .07 | 4.81 | 3.23 |
| | Age | .08 | 4.38 | 2.59 |

*Aging conditions were 4 months at normal ambient conditions.

The samples containing organophosphine palladium chelate showed considerable improvement over the gold salts in contrast and maximum density.

EXAMPLE 3

A silver iodobromide emulsion was made according to Procedure C and remelted according to Procedure E above with the variations indicated as follows. To one portion of the emulsion used as a control there was added $3.4 \times 10^{-4}$ moles of a conventional sulfur sensitizer, $8.2 \times 10^{-4}$ mole of potassium thiocyanate, and $3.3 \times 10^{-6}$ moles of $Au^{+3}$ per 1.5 moles of silver halide. To another emulsion there was added $17.4 \times 10^{-5}$ mole of $S_2O_3^{-2}$ and $2.5 \times 10^{-4}$ mole of phosphine-palladium chelate shown as Compound I above. One strip of each coated emulsion was exposed through a $\sqrt{2}$ step wedge at $10^{-6}$ seconds in an Edgerton, Germeshausen and Grier flash tube sensitometer Mark VII and developed for 1½ minutes at 80° F. in a commercial high contrast, lithographic hydroquinone-formaldehyde-bisulfite developer, fixed, washed and dried. The test results are shown in the following table:

TABLE III

| Strip No. | Test Conditions* | Dmin. | Dmax. | Relative Speed Density = 1.0 |
|---|---|---|---|---|
| 1 (Control) | Fresh | .03 | 1.73 | 100 |
| | Oven | .04 | 1.37 | 100 |
| 2 (Sample) (Compound | Fresh | .27 | 1.99 | 271 |

TABLE III-continued

| Strip No. | Test Conditions* | Dmin. | Dmax. | Relative Speed Density = 1.0 |
|---|---|---|---|---|
| I) | Oven | .04 | 2.08 | 184 |

*Oven conditions were the same as those designated under Table I.

Sample strips were also exposed and processed as described in the testing procedure of Example 1 to give the following results.

TABLE III -A

| Strip No. | Test Conditions* | Dmin. | Dmax. | Relative Speed Density = 1.0 |
|---|---|---|---|---|
| 1 (Control) | Fresh | .03 | 3.42 | 100 |
| | Oven | .04 | 3.43 | 100 |
| 2 (Compound I) | Fresh | .06 | 4.36 | 249 |
| | Oven | .05 | 4.26 | 382 |

The above results demonstrate that the organophosphine-palladium chelate more efficiently produces greater sensitization than conventional chemical sensitizer combinations.

EXAMPLE 4

Silver iodobromide emulsions were made and remelted as described in Example (3) and tested as described in Example (1). Emulsion (1) was used as a control and contained only the sensitizing adjuvants set forth in Procedure E. Emulsions (2) and (3) contained the same sulfur sensitizer plus $1 \times 10^{-4}$ moles of compounds I and XXVI respectively per 1.5 moles of silver halide, but no gold.

The compounds were added either at digestion or as a final as indicated in the table below. The emulsions were exposed and tested as described in Example 3. The first testing conditions described therein gave the following results.

TABLE IV

| Emulsion No. | Where Compounds Were Added | Dmin. | Dmax. | Relative Speed Density = 1.0 |
|---|---|---|---|---|
| 1 (Control) | Digestion | .03 | 1.61 | 137 |
| 2 (Compound I) | Digestion | .29 | 2.24 | 302 |
| 3 (Compound I) | Final Addition* | .04 | 2.06 | 189 |
| 4 (Compound XXV) | Digestion | .16 | 2.65 | 364 |
| 5 (Compound XXV) | Final Addition* | .03 | 1.45 | 141 |

*Added just prior to coating.

The results indicate that the palladium chelates of organophosphine produce greater response than gold sensitization whether added during digestion or as a final addition just prior to coating.

EXAMPLE 5

Silver iodobromide emulsions were made as described in Example 3 and one emulsion (1) which was used as a control was remelted with the chemical sensitizers according to Procedure E above. In addition there was added $8.28 \times 10^{-4}$ mole of potassium thiocyanate per 1.5 moles of silver halide. A similar emulsion (2) was remelted as in Procedure E but in place of the gold sensitizer and potassium thiocyanate there was added $2.5 \times 10^{-5}$ mole of Compound I above. The emulsions were coated and exposed and tested by the method described in Example (1) to give the following sensitometric results.

TABLE V

| Emulsion No. | Dmin. | Dmax. | Relative Speed Density = 1.0 |
|---|---|---|---|
| 1 (Control) | .03 | 2.77 | 100 |
| 2 (Compound I) | .04 | 5.50 | 314 |

EXAMPLE 6

Silver iodobromide emulsions were prepared according to Procedure C above. Two emulsions (1) and (4) were remelted according to Procedure E plus the addition of $8.2 \times 10^{-4}$ mole of potassium tiocyanate per 1.5 moles of silver halide. Other emulsions (2) and (5) were remelted according to Procedure E except but in place of the gold salt and potassium thiocyanate there was added $2.5 \times 10^{-4}$ mole of Compound I per 1.5 moles of silver halide and also to Emulsion (5) there was added 0.2 g per 1.5 mole of silver halide of the optical sensitizing dye: 3,3'-bis (γ-sulphopropyl)-9-methylthiacarbocyanine anhydrohydroxide. Emulsions (3) and (6) were remelted according to Procedure E but in place of the gold salt and potassium thiocyanate there was added $2.5 \times 10^{-4}$ mole of compound XXV per 1.5 moles of silver halide and in addition there was added to Emulsion (6) 0.2 g. of the above optical sensitizing dye per 1.5 moles of silver halide. The emulsions were coated and tested as described in Example 1 to give the following sensitometric results:

TABLE VI

| Emulsion No. | Dmin. | Dmax. | Relative Speed Density = 1.0 | Sensitizing Dye |
|---|---|---|---|---|
| 1 (Control) | .05 | 2.25 | 100 | none |
| 2 (Compound I) | .04 | 5.09 | 3200 | none |
| 3 (Compound XXV) | .28 | 4.81 | 720 | none |
| 4 (Control) | .04 | 2.57 | 100 | 0.2 g/1.5 moles AgHal |
| 5 (Compound I) | .05 | 4.99 | 2676 | " |
| 6 (Compound XXV) | .22 | 4.24 | 475 | " |

Compared to the controls the data show that the organophosphine-metal chelates give strong chemical sensitization and can be used in the presence of optical sensitizing dyes.

EXAMPLE 7

Silver chlorobromide emulsions were prepared according to Procedure A above and emulsion (1) was remelted according to Procedure E and used as a control. Emulsions (2), (3), (4) and (5) were remelted using Compounds IV, V, VII and IX respectively in addition to the gold salt and thiosulfate sensitizers in Procedure E. All of the chelates were added in amounts of $3.4 \times 10^{-4}$ mole per 1.5 moles of silver halide. Sensitometric strips were exposed and tested according to the testing procedures of Example 3 to give the following results:

TABLE VII

| Emulsion No. | 1st Test Proc. (Ex. 3) Dmin. | 1st Test Proc. (Ex. 3) Dmax. | Test Proc. (Ex. 1) Dmin. | Test Proc. (Ex. 1) Dmax. |
|---|---|---|---|---|
| 1 (Control) | .03 | .28 | .04 | 1.08 |
| 2 (Compound IV) | .03 | .42 | .04 | 1.58 |
| 3 (Compound V) | .08 | 1.11 | .10 | 2.91 |
| 4 (Compound VII) | .04 | .29 | .07 | 2.00 |
| 5 (Compound | .03 | .44 | .04 | 1.73 |

TABLE VII-continued

| Emulsion No. | 1st Test Proc. (Ex. 3) Dmin. | Dmax. | Test Proc. (Ex. 1) Dmin. | Dmax. |
|---|---|---|---|---|
| IX) | | | | |

Data show that various members of the organophosphine noble metal chelates have sensitizing activity in silver halide emulsions.

EXAMPLE 8

Silver iodobromide emulsions were prepared according to Procedure B above and remelted according to Procedure E except that no gold sensitizer was used. In place of gold the compounds listed by number above were added in an amount of $3.4 \times 10^{-4}$ moles per 1.5 moles of silver halide. The emulsions were coated and tested according to the procedures set forth in Example 3, with these results:

TABLE VIII

| Emulsion No. | 1st Test Proc. of Ex. 3 Dmin. | Dmax. | Total Density | 2nd Test Proc. Ex. 3 Dmin. | Dmax. | Total Density |
|---|---|---|---|---|---|---|
| 1 (Control) | .03 | 1.32 | 1.35 | .03 | 2.80 | 2.83 |
| 2 Compound II | .03 | 2.58 | 2.61 | .04 | 2.56 | 2.60 |
| 3 Compound III | .03 | 1.83 | 1.86 | .03 | 3.27 | 3.30 |
| 4 Compound IV | .03 | 1.76 | 1.79 | .03 | 2.81 | 2.84 |
| 5 Compound VI | .04 | 1.52 | 1.56 | .03 | 2.97 | 3.00 |
| 6 Compound VII | .05 | 1.48 | 1.53 | .04 | 3.61 | 3.65 |
| 7 Compound IX | .25 | 1.45 | 1.70 | .11 | 3.73 | 3.84 |
| 8 Compound X | .04 | 1.36 | 1.40 | .06 | 2.93 | 2.99 |
| 9 Compound XI | .05 | 1.69 | 1.74 | .05 | 2.84 | 2.89 |
| 10 Compound XII | .04 | 2.48 | 2.52 | .04 | 3.08 | 3.12 |

The data show that the organophosphine-noble metal chelates as a class show sensitizing activity.

EXAMPLE 9

Silver chlorobromide emulsions were made according to Procedure A and remelted according to Procedure E except that no gold sensitizer was added; and except for Emulsion Number 1 used as a control, the emulsions contained $3.4 \times 10^{-4}$ moles per 1.5 moles of silver halide of the compounds listed above. The coated emulsions were tested according to the testing procedure of Example 1 to give the following results.

TABLE IX

| Emulsion No. | Dmin. | Dmax. | Speed Density = 1.5 |
|---|---|---|---|
| 1 (Control) | .04 | 1.63 | 100 |
| 2 (Compound XV) | .06 | 2.27 | 1456 |
| 3 (Compound XVI) | .11 | 2.72 | 4160 |
| 4 (Compound XVII) | .04 | 1.97 | 1200 |
| 5 (Compound XVIII) | .04 | 1.68 | 416 |
| 6 (Compound XIX) | .09 | 3.17 | 2784 |

A number of chelates are thus shown to be sensitizers.

EXAMPLE 10

Silver iodobromide emulsions were made according to Procedure B and remelted as described in Procedure E except that no gold sensitizer was added; and except for Emulsion I used as a control, there was added $3.4 \times 10^{-4}$ mole per 1.5 moles of silver halide of the compounds listed above. The emulsions were tested according to the procedure described in Example 1. Results given in the table below show a number of complexes to be sensitizers.

TABLE X

| Emulsion No. | Dmin. | Dmax. | Speed Density = 1.5 |
|---|---|---|---|
| 1 (Control) | .04 | 3.00 | 100 |
| 2 (Compound XV) | .30 | 4.17 | 800 |
| 3 (Compound XVI) | .15 | 3.53 | 424 |
| 4 (Compound XVII) | .06 | 3.75 | 698 |
| 5 (Compound XVIII) | .12 | 4.22 | 786 |
| 6 (Compound XIX) | .08 | 4.28 | 518 |
| 7 (Compound XX) | .24 | 3.59 | 800 |
| 8 (Compound XIII) | .19 | 3.24 | >800 |
| 9 (Compound XIV) | .04 | 2.85 | 148 |

EXAMPLE 11

Silver chlorobromide emulsions were made as described in Procedure A above except that varying amounts per 1.5 moles of silver halide as shown in the table below of Compound I were added to the aqueous potassium chloride solution before the precipitation of the silver chloride. The emulsions were remelted according to Procedure E and tested according to the method described in Example 1 to give the following results.

TABLE XI

| Emulsion No. | Dmin. | Dmax. | Speed Density=1.0 | Gradient Density =0.2–1.0 |
|---|---|---|---|---|
| 1 (Control) | .05 | 1.53 | 100 | 0.79 |
| 2 (0.0005 gram) | .04 | 1.99 | 122 | 1.40 |
| 3 (0.0025 gram) | .05 | 2.12 | 60 | 1.45 |
| 4 (0.005 gram) | .14 | 2.30 | 17 | 1.41 |
| 5 (0.02 gram) | .52 | 2.52 | 15 | 1.62 |

EXAMPLE 12

Silver chlorobromide direct positive emulsions were made following Procedure A above except that one emulsion was made by adding 0.005 gram of Compound I above to the aqueous gelatin potassium chloride solution before precipitation of the silver chloride. The emulsion was remelted according to Procedure D except that $2.4 \times 10^{-6}$ moles of cesium thioborane per 1.5 mole of silver halide was added as a chemical fogging agent. The coated emulsion samples were tested by exposing them in a sensitometer using a quartz-iodine lamp through a $\sqrt{2}$ step wedge providing 15 luxometer units equal to 514,000 meter-candle-seconds. The strips were developed at 80° F for 1.5 minutes in a commercial, high contrast, hydroquinone-formaldehyde bisulfite developer. The sensitometric results are shown in the following table.

TABLE XII

| Emulsion No. | Dmin. | Dmax. | Speed Density=1.0 |
|---|---|---|---|
| 1 (Control) | .07 | 2.92 | 100 |
| 2 Compound I (0.005 g. in | .06 | 2.58 | 187 |

TABLE XII-continued

| Emulsion No. | Dmin. | Dmax. | Speed Density=1.0 |
|---|---|---|---|
| KCl sol.) | | | |

EXAMPLE 13

Silver iodobromide emulsions were prepared according to Proceudre C and remelted according to Procedure E except that $2.5 \times 10^{-5}$ mole of Compound I per 1.5 moles of silver halide was added in place of the gold sensitizer and the amount of gelatin was varied as shown in Table below. The emulsion test strips were exposed for $10^{-6}$ second on an Edgerton, Germeshausen and Grier flash tube sensitometer Mark VII and developed for 1½ minutes at 80° F in a commercial, high contrast, hydroquinone formaldehyde-bisulfite developer, fixed and dried to give the sensitometric results shown in the following table.

TABLE XIII

| Emulsion No. | Coating Weight $MgsAgNO_3/ft^2$ | Grams of Gelatin/ 1.5 moles AgHal | Dmin. | Dmax. | Speed Dens. =1.0 |
|---|---|---|---|---|---|
| 1 (Control) | 388 | 124 | .03 | 2.54 | 100 |
| 2 Compound I | 480 | 80 | .03 | 3.02 | 120 |
| 3 Compound I | 381 | 40 | .02 | 3.90 | 144 |

The data show that high gelatin content is not necessary to obtain sensitization with the chelates of the invention.

EXAMPLE 14

Silver iodobromide emulsions were made according to Procedure C above and remelted as described in Procedure E, except that no gold sensitizer was used, but Compound I and XXV were used in place of the gold in the amounts shown in the table. The emulsion samples were exposed and tested according to the procedure described in Example 1. Data given in Table XIV show that when close to optimum concentration, Compound XXV produces improved response over Compound I.

TABLE XIV

| Emulsion No. | Remelt Adjuvants/ 1.5 moles AgHal | Ctg. Wt. $MgAgNo_3/ft^2$ | Dmin. | Dmax. | Rel. Speed Den.=1.0 | Cover-* ing Power |
|---|---|---|---|---|---|---|
| 1 (Comp. I) | $2.5 \times 10^{-5}$ | 416 | .03 | 2.83 | 100 | 99 |
| 2 ("XXV) | $2.5 \times 10^{-5}$ | 473 | .04 | 3.55 | 159 | 109 |
| 3 ("I) | $8.0 \times 10^{-5}$ | 469 | .03 | 4.91 | 353 | 153 |
| 4 ("XXV) | $8.0 \times 10^{-5}$ | 391 | .05 | 5.08 | 574 | 189 |

$$^{*}\text{Covering Power} = \frac{\text{Dmax}}{\text{Coating wt. expressed as grams of Ag/DM}^2}$$

Covering power is a measure of efficiency.

EXAMPLE 15

Silver iodobromide emulsions were made as described under Procedures C and E except for the following variations in Procedure E. The normal quantity of gold sensitizer was used in Emulsion No. 1 but in place of gold sensitizer in the other emulsions, compounds were used as indicated in the following table. The emulsion samples were exposed and developed according to the method described in Example 1. The results show that the phosphinite-palladium samples gave better speed and Dmax than either the gold sensitizers or the platinum or palladium compounds of the prior art.

TABLE XV

| Emulsion No. | Remelt Adjuvants/ 1.5 moles AgHal | Dmin. | Dmax. | Relative Speed (Den.=1.0 |
|---|---|---|---|---|
| 1 | $3.3 \times 10^{-6}$ mole $Au^{+3}$ | .03 | 2.75 | 100 |
| 2 | $1.0 \times 10^{-4}$ mole $PdCl_2$ | .03 | 2.06 | 82 |
| 3 | $1.0 \times 10^{-4}$ mole $K_2PtCl_4$ | .03 | 2.23 | 118 |
| 4 | $1.0 \times 10^{-4}$ mole Comp'd V | .06 | 3.74 | 353 |

As indicated by the various examples, the novel organophosphine noble metal chelates of this invention may be used as the sole sensitizer in silver halide systems or they may be used in conjunction with other known sensitizers, i.e., sulfur and noble metal salt compounds. There may also be used reducing agents, e.g., stannous salts, compounds which sensitize by development acceleration, e.g. polyoxyethylene compounds and the polyhydral boranes disclosed in Bigelow, U.S. Pat. Nos. 3,779,777 and 3,761,275. In addition, optical sensitizing dyes can be used in the silver halide emulsion system using the novel organophosphine sulfide compounds of this invention.

Silver halide emulsions sensitized according to the teachings of this invention can also contain the conventional additions such as plasticizers for the colloid carrier in which the silver halide crystals are dispersed, antifoggants such as thiazoles, triazoles, tetrazaindenes and the like. Other silver salts in addition to those mentioned above may be used for the invention.

The silver salt emulsions of this invention may be made with any of the macromolecular, water-permeable colloids known to be suitable for the purpose of acting as a colloid carrier for silver halide crystals. Besides the most commonly used colloid carrier, gelatin, there may be used polyvinyl alcohol and its derivatives, e.g., partially hydrolyzed polyvinyl acetate, ethers, and acetals, hydrolyzed interpolymers of vinyl acetate and unsaturated addition compounds such as maleic acid anhydride, acrylic and methacrylic acid esters, poly-N-vinyllactams, polysaccharides e.g., dextran, dextrin, etc., the hydrophilic copolymers disclosed in Shacklett, U.S. Pat. No. 2,833,650, hydrophilic cellulose ethers and esters, and acrylamide polymers. Mixture of these binders can also be used as well as water-permeable binding agents containing dispersed polymerized vinyl compounds such as those disclosed in Nottorf, U.S. Pat. No. 3,142,568.

The emulsions of this invention may be coated on any suitable support including photographic quality paper and film. For example cellulose supports, e.g., cellulose acetate, cellulose triacetate, cellulose mixed esters, etc., may be used. Polymerized vinyl compound, e.g., copolymerized vinyl acetate and vinyl chloride, polystyrene and polymerized acrylate may also be mentioned. The film formed from the polyesters made according to the teachings of Alles, U.S. Pat. No. 2,779,684 and the patents referred to therein may be used. Other suitable supports are the polyethylene terephthalate/isophthalates of British Pat. No. 766,290 and Canadian Pat. No. 562,672 and those obtainable by condensing terephthalic acid and dimethylterephthalate with propylene glycol, tetramethylene glycol or cyclohexane-1,4-dimethanol (hexanhydro-p-xylene alcohol). The films of Bauer et al. U.S. Pat. No. 3,059,543 may also be used. The above polyester films are particularly suitable because of their dimensional stability.

I claim:

1. A light-sensitive silver halide photographic element comprising a support coated with at least one silver halide emulsion containing as a chemical sensitizer a chelate of an organophosphine with a platinum or palladium salt, the latter being present in an amount sufficient to sensitize the silver halide emulsion.

2. The photographic element of claim 1 wherein the Pt or Pd salt is a halide.

3. The photographic element of claim 1 wherein the Pt or Pd salt is a chloride.

4. The photographic element of claim 1 wherein the chelate has the formula

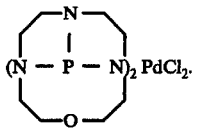

5. The photographic element of claim 1 wherein the chelate has the formula $[CH_3P(OPh)_2]_2PtCl_2$ wherein Ph = phenyl.

6. The photographic element of claim 1 wherein the chelate has the formula $(Ph_2POCH_3)_2PdCl_2$ wherein Ph = phenyl.

7. The photographic element of claim 1 wherein the chelate has the formula $[PhP(CH_3)_2]_2PdCl_2$ wherein Ph = phenyl.

8. The photographic element of claim 1 wherein the chelate has the formula

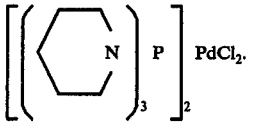

9. A photographic silver halide emulsion containing a sufficient amount of an organophosphine chelate of a Pt or Pd salt to chemically sensitize the emulsion.

* * * * *